US007237366B2

(12) United States Patent
Donahey et al.

(10) Patent No.: US 7,237,366 B2
(45) Date of Patent: Jul. 3, 2007

(54) POST-TENSIONED INSULATED WALL PANELS

(75) Inventors: Rex C. Donahey, West Des Moines, IA (US); Kim E. Sceber, Cantonment, FL (US); Robert T. Lone, Sr., Ames, IA (US)

(73) Assignee: Composite Technologies Corporation, Boone, IA (US)

( * ) Notice: Subject to any disclaimer, the term of this patent is extended or adjusted under 35 U.S.C. 154(b) by 179 days.

(21) Appl. No.: 10/601,372

(22) Filed: Jun. 23, 2003

(65) Prior Publication Data

US 2004/0255530 A1 Dec. 23, 2004

Related U.S. Application Data

(60) Provisional application No. 60/390,726, filed on Jun. 21, 2002.

(51) Int. Cl.
*E04C 3/20* (2006.01)
*E04B 1/62* (2006.01)

(52) U.S. Cl. ..... 52/404.2; 52/410; 52/426; 52/309.12; 52/745.21; 52/223.13

(58) Field of Classification Search .... 52/223.6–223.8, 52/223.1, 309.7, 309.9, 309.11, 309.12, 309.14, 52/309.16, 309.17, 223.13, 223.14, 125.1, 52/309.4, 426, 439, 404.1, 404.2, 404.5, 52/745.21, 410, 431, 43
See application file for complete search history.

(56) References Cited

U.S. PATENT DOCUMENTS 3,295,278 A * 1/1967 Muhm ..... 52/223.6
3,353,315 A * 11/1967 Barker ..... 52/275
3,457,890 A * 7/1969 Parker et al. ..... 114/74 A
4,117,639 A * 10/1978 Steenson et al. ..... 52/223.6
4,157,640 A * 6/1979 Joannes ..... 52/309.7
4,272,065 A * 6/1981 Steenson et al. ..... 269/46
4,489,530 A * 12/1984 Chang ..... 52/745.09
4,627,203 A * 12/1986 Presswalla et al. ..... 52/220.5
4,703,602 A * 11/1987 Pardo ..... 52/564
4,785,602 A 11/1988 Giurlani
4,903,446 A * 2/1990 Richards et al. ..... 52/223.6
5,095,674 A * 3/1992 Huettemann ..... 52/405.3
5,113,630 A * 5/1992 Murray ..... 52/223.6
5,398,470 A * 3/1995 Ritter et al. ..... 52/309.11
5,440,846 A * 8/1995 Record ..... 52/309.15
5,619,829 A * 4/1997 Tan et al. ..... 52/293.3
5,678,373 A * 10/1997 Franklin et al. ..... 52/439
5,931,618 A 8/1999 Wallace
6,088,985 A * 7/2000 Clark ..... 52/309.11
6,119,417 A * 9/2000 Valverde et al. ..... 52/223.7
6,138,981 A * 10/2000 Keith et al. ..... 249/41
6,282,853 B1 9/2001 Blaney
6,434,900 B1 * 8/2002 Masters ..... 52/283
6,438,923 B2 * 8/2002 Miller ..... 52/745.19
6,568,730 B1 * 5/2003 Paterson ..... 52/125.5
2003/0115822 A1 * 6/2003 Lejeune et al. ..... 52/677

* cited by examiner

*Primary Examiner*—Winnie Yip
(74) *Attorney, Agent, or Firm*—Kent A. Herink; Emily E. Harris

(57) ABSTRACT

An insulated concrete panel having one or more tendons positioned in the insulation layer inside the panel which are put into tension after the concrete panel has been formed.

10 Claims, 3 Drawing Sheets

POST-TENSIONED INSULATED WALL PANELS

This application claims priority to U.S. Patent Application Ser. No. 60/390,726, filed Jun. 21, 2002.

BACKGROUND OF THE INVENTION

The invention relates generally to insulated concrete wall panels and, more specifically, to insulated concrete wall panels having tendons or rods that lie in the plane of the insulation and are placed under tension after the concrete panel has been cast.

Insulated precast concrete wall panels are well known in the art of building construction. Two general methods of panel fabrication are used, site-cast construction, in which the panels are fabricated horizontally at the building site and where they are subsequently erected, and plant-cast construction, in which the panels are fabricated horizontally at a fixed, remote plant and are shipped to the building site for erection.

A wall panel, at a minimum, must be capable of resisting forces applied both normal to and in its plane. Normal forces can result from environmental effects, such as wind, and geologic effects, such as from earthquakes. In-plane forces can also result from wind or earthquake, but are imposed on the wall panels through connections with the horizontal elements in the building, including horizontal roof bracing or diaphragms created by roof or floor systems. The weight of the panel will create in-plane forces, and, in many cases, a wall may also be required to carry superimposed gravity loads from roof or floor structures. Although columns that are independent from the walls could be used to carry these gravity loads, it is often economical—both in material and floor space—if the walls are used to support the perimeter of the roof or floor structures in lieu of an exterior colonnade.

Additional forces that must be considered in the design of wall panels include forces imposed during handling and erection of the panels, as well as internal forces created by temperature and shrinkage differentials that occur after the panel is erected.

Because concrete is itself a relatively brittle material with a low tensile capacity, it must be reinforced with a material capable of carrying large tensile strains without fracture. Although fiber composite materials can be used, the most common reinforcing material used in wall construction is steel. Regardless of the material used, the stress in the reinforcing at the time of fabrication defines still more subsets of wall construction types.

These additional types of wall construction are, in general, reinforced concrete and prestressed concrete. In reinforced concrete, the initial strain in the steel is essentially equal to the initial strain in the concrete. The steel is placed in forms, followed by plastic concrete. When the concrete hardens sufficiently, the panel is ready for handling and erection, where the steel and the concrete are subjected to both tensile and compression strains. In contrast, even before handling, prestressed concrete is fabricated such that the strain in the steel is tensile and the strain in the concrete is compressive. The pre-imposed compressive strain in the concrete has a number of advantages, which will be discussed in more detail elsewhere in this specification. It is of interest to note that the shrinkage of concrete after it sets actually creates tensile strains in the concrete as well as compressive strains in the steel.

Within the classification of prestressed concrete, two further subsets of pre-tensioned and post-tensioned construction exist. These subsets are defined by the sequence and the methods used to prestress the reinforcing material and to transfer compressive stresses into the concrete. In pre-tensioned construction, the reinforcing material is placed in tension by jacking against a relatively stiff form or bed. The form or bed therefore supplies the reaction necessary to pull the reinforcing material. While the form or bed is therefore placed in compression, the strain in the bed has only a minor effect on the final wall panel itself. Plastic concrete is placed around the pre-tensioned steel and is allowed to cure and harden. When the concrete has reached a sufficient compressive strength to survive the imposition of compressive and flexural stresses imposed by the action, the external restraint is removed from the reinforcing. The reinforcing therefore shortens and imposes significant compression strains in the concrete itself, usually through bond between the concrete and the steel.

In post-tensioned construction, the initial construction sequence and therefore the initial strain in the concrete is nearly the same as those for reinforced concrete. The one major exception is that some or much of the reinforcing is isolated from contact with the plastic concrete. After the concrete has hardened and reached sufficient strength, this isolation allows the reinforcing to be tensioned by using the concrete member itself to supply the reaction. In this case, the concrete within the panel is placed in compression, and this compression is maintained by placing an anchorage that allows the tension in the reinforcing to be transferred as a compressive reaction at each end of the post-tensioned reinforcing.

Although tensile forces can arise from all sources cited above (including eccentrically applied prestressing), tensile forces resulting from flexural loads imposed by wind or earthquake as well as internal forces arising from temperature effects are usually the most significant.

Post-tensioning systems are well known in the art. Systems that incorporate threaded tension members are, for example, supplied by Dywidag and Williams Form Engineering. The Dur-O-Wall® Sure-Stress™ post-tensioning system is an example of similar systems used in masonry construction, and includes the use of steel rods and load-indicating washers.

One form of direct tension indicating washers are described in U.S. Pat. No. 5,931,618. These washers include indicating material, normally silicone, which is positioned in indentations within each washer. As the nut is turned on the bolt or, in this case, the post-tensioning tendon or rod, the tendon is placed in tension and the washer is compressed. As the indentations are flattened, channels formed from the indentations to the outside diameter of the washer allow the indicating material to migrate to the outer diameter of the washer. Sufficient washer compression and resulting rod tension are indicated when a designated number of channels have carried the indicating material to the exposed perimeter of the washer.

Lifting inserts and devices are well known in the art. The inserts are normally cast in the concrete layers and are loaded using proprietary lifting clutches that, in turn, connect to wire ropes. Examples of lifting devices that can be used with threaded rods are also known in the art. The Dayton/Richmond Swivel Lifting Plate consists of a heavy steel casting and a drop forged bail that is pinned to allow a full 180° swivel.

SUMMARY OF THE INVENTION

The invention consists of insulated concrete sandwich wall panels including tendons that lie in the insulation layer and which are tensioned after casting of the concrete layers. A first concrete layer is formed in a casting bed and receives the end portion of a plurality of fasteners or connectors that will extend into a second concrete layer. An upper and lower anchor plate are preferably positioned in the casting bed so as to be bonded to the first concrete layer. After casting of the first concrete layer, a layer of insulation is positioned atop the first concrete layer. Preferably, the insulation has been preformed with passages for the exposed end portions of the fasteners or connectors. A tendon is received in and extends between each of the anchor plates, with a free end portion extending beyond each plate. The second concrete layer is then cast on the insulation layer. After the concrete has cured sufficiently, the tendon is tensioned or stressed by a nut that is threaded on to each free end portion of the tendon and tightened to the desired tension.

The post-tensioned insulated concrete panels of the present invention have a reduced thickness and weight for a given strength compared to known insulated concrete panels. Prestressed concrete wall panels must be constructed using fixed casting beds remote from the construction site. The present post-stressed panels may be constructed using temporary casting beds either at a facility or at the construction site. Prior art post-tensioned construction can be labor-intensive and dangerous as a plurality of unbonded tendons must be located near the surfaces of the wall panel. Coupled with the use of sandwich panel connectors with high stiffness, the present panels with the tendons located between the concrete layers allows the construction of post-tensioned insulated concrete wall panels that are relatively thin and lightweight, that reduce the labor required for construction, and provides for increased safety when compared with the current methods of post-tensioned wall construction.

An object of the invention is to provide a thin, lightweight, strong and thermally efficient post-tensioned insulated concrete wall panel.

Another object of the invention is to provide a method of manufacturing a thin, lightweight, strong and thermally efficient post-tensioned insulated concrete wall panel.

A further object of the invention is to provide a post-tensioned insulated concrete wall panel that has the tension members located in the insulation layer.

These and other objects of the invention will be appreciated by those skilled in the art upon a review of this specification, the associated drawings, and the appended claims.

DESCRIPTION OF THE INVENTION

The current invention comprises post-tensioned insulated concrete sandwich panels that are tensioned post-tensioning elements that include longitudinal elements, such as high-strength strands, bars or rods that lie in the plane of the insulation layer of the sandwich panel. The invention also comprises the method of design as well as the method of construction of said panels. For purposes of this application, the post-tensioning elements include plain or deformed steel or fiber composite rods or bars as well as prestressing strand and wire.

Figure 1:
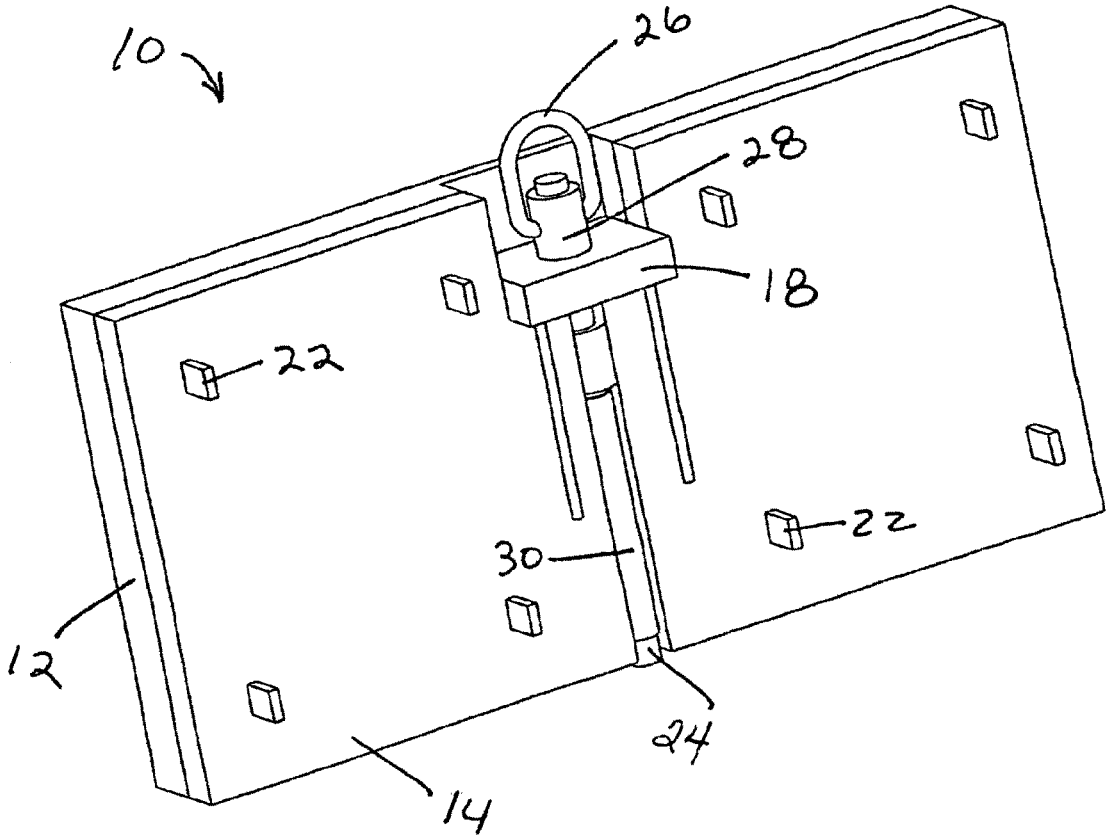
FIG. 1 is perspective view of a post-tensioned insulated concrete sandwich panel wherein one of the layers has been removed to show the post-tensioning tendon and one of the anchor plates.
Figure 2:
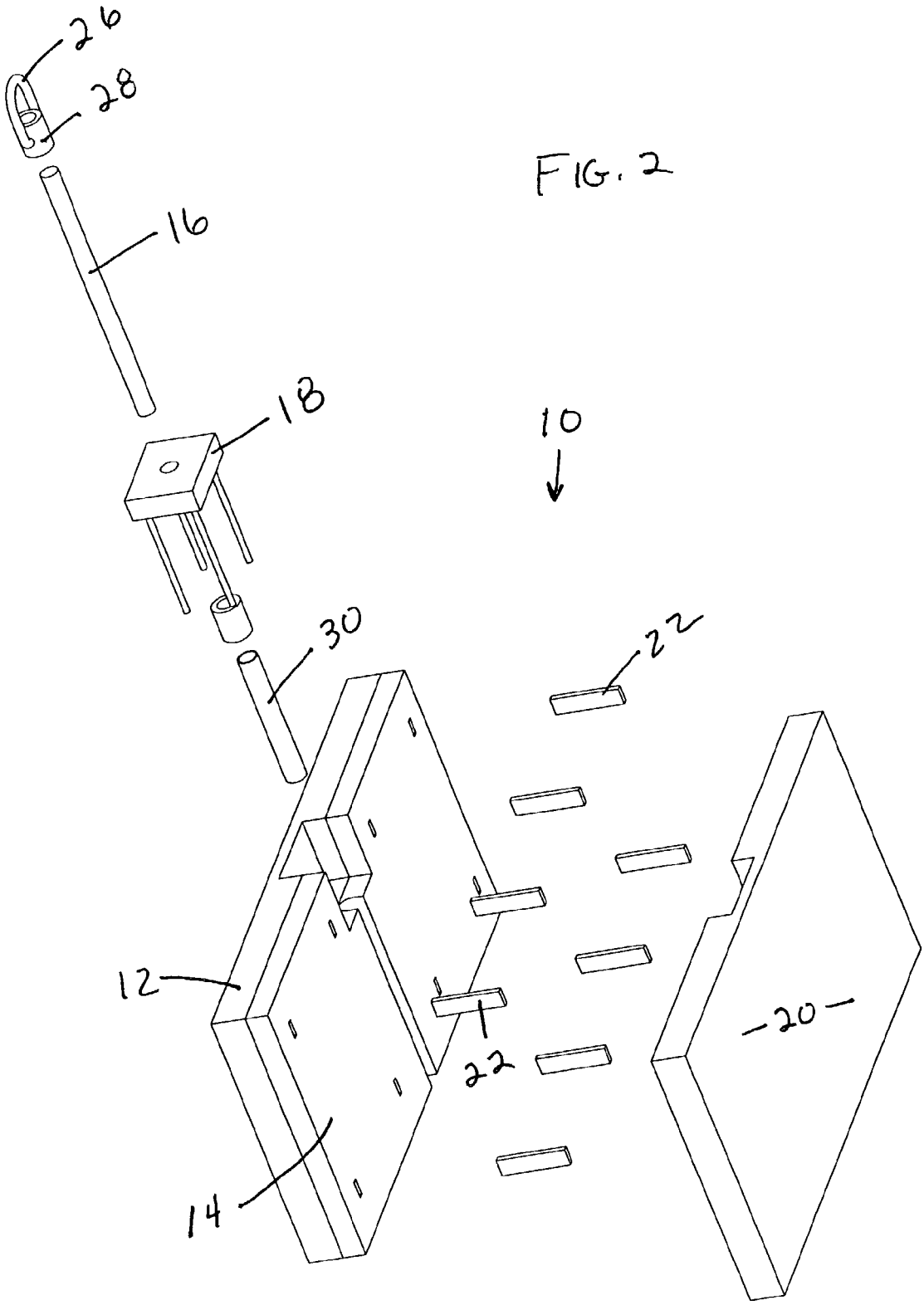
FIG. 2 is an exploded perspective view corresponding to FIG. 1, and further illustrating the second concrete layer.
Figure 3:
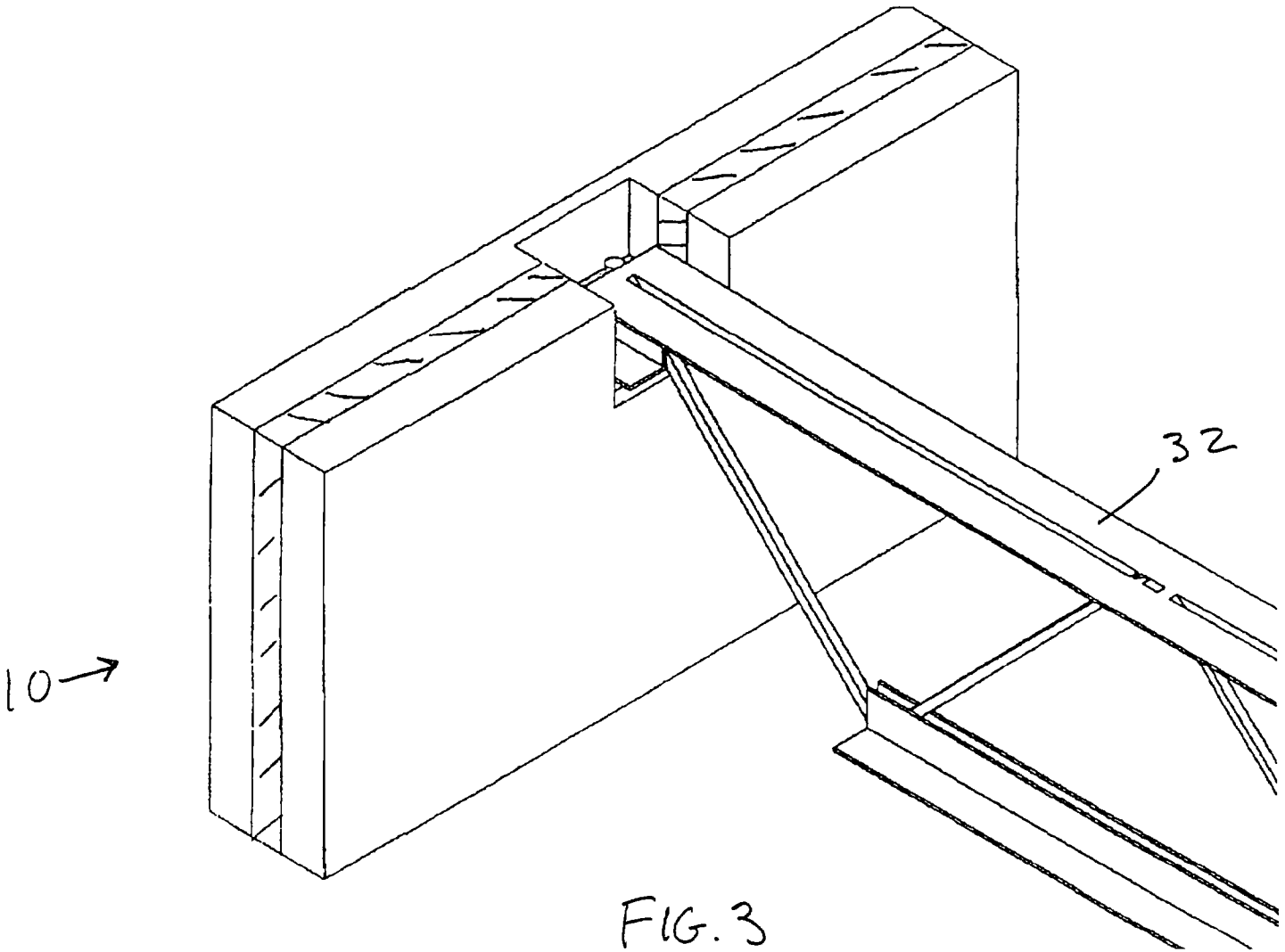
FIG. 3 is a perspective view of the post-tensioned insulated concrete sandwich panel supporting a roof structure.

FIGS. 1 through 3 show the upper portion of a sandwich panel, indicated generally at 10, of the present invention. The sandwich panel 10 is constructed in a preferred embodiment by placing an initial concrete layer 12 in a casting bed or formwork, followed by the installation of an insulation layer 14 and post-tensioning tendon assembly inc1uding tendon 16. A pair of anchor plates, one of which is illustrated at 18, for the post-tensioning tendon 16 are installed in the formwork prior to placement of the initial concrete layer 12 and are included in the tendon assembly. It is preferred that the anchor plate 18 is recessed a nominal distance from the top of the sandwich panel 10. A second concrete layer 20 is cast or formed on top of the insulation layer 14.

A plurality of sandwich panel connectors 22 are installed through the insulation layer 14. Preferably, the connectors 22 are fabricated from a material that provides low thermal conductivity. Further, the connectors 22 are preferably fabricated from a material and with a geometry that provides a stiff shear-transfer device to produce partial composite action in the panel 10. It should be noted that the anchor plates 18, if embedded in the concrete layers 12 and 20 as in the preferred embodiment, will provide additional composite action. However, because the anchor plates 18 are limited to the ends of the panel span, they alone are not capable of producing adequate composite action.

Load transfer blocks 24 are installed at periodic distances along the length of the panel 10. These blocks 24 transfer, for example, normal wind pressures from the exterior layer 12 of concrete to the post-tensioning tendon 16. This transfer, in turn, allows the tendon 16 to assist in carrying the lateral load to the panel supports.

The panel can be brought to the vertical position using, in part, a lifting clevis 26 that is attached to the tendon 16 adjacent to the anchor plate 18. FIG. 3 shows the completed panel assembly with the option of using the anchor plate and its pocket to form the bearing and attachment point for a roof joist 32.

Prior to tilting or lifting of the panel, the post-tensioning tendons 16 must be tensioned to a pre-determined stress value. The tensioning may be accomplished by either the use of a hydraulic stressing jack or, for tendons comprising threaded rods, by tightening of a nut 28 on the "live" end of the tendons 16. The desired tension level is assured by measuring the tendon elongation. It is also possible to use load-indicating washers or jack pressure to verify the tension level determined by elongation measurement.

The anchor plates 18 provide a number of benefits over their fundamental function as post-tensioning anchors and stress transfer points. First, they provide a natural lifting anchor. Second, they provide a very stiff shear transfer anchor near the panel supports. Third, they can, with modest or no modification, provide connection points for the panel-to-foundation and the panel-to-roof connections.

The precast wall panel 10, whether site-cast or plant-cast, must be rotated from a horizontal to vertical position. In the classical site-cast system, lifting inserts are distributed on the back face of the panel. During tilting of the panel, the weight of the panel is shared between the back-face anchors (and the casting surface when the panels are never actually "lifted"). With the current invention, the upper line of connectors 22 is effectively shifted to the top of the panel 10. In fact, because when compared with the current-art panel the panel weight is significantly reduced, it is entirely possible that the full panel weight can be carried by the sum of the post-tensioning anchor points. For panels less than 25 ft in height, it also conceivable that the only tilting anchors required will be the post-tensioning anchor points. For longer panels, perhaps only one or two rows of back-face anchors will be required to execute the tilt.

When the post-tensioning tendons 16 comprise rods or bars, a coupling can be used to extend the tendon to a point above the "dead" end of the tendon. At this point, a swivel plate can be installed to provide a series of lifting points. Alternatively, the anchor plate may be fabricated with studs or lugs that allow the installation of a clevis or lifting clutch.

For the life of the panel 10, the post-tensioning anchor plates 18 will act as shear transfer devices between the two concrete layers 12 and 20. The plates 18 can be stiffened by the simple addition of shear plates, although this will not be necessary in most cases. A primary benefit of these plates 18 is that they will dramatically reduce the temperature-induced shear displacement between layers 12 and 20. The temperature-induced displacement of the other connectors 22 in the panel will be reduced, but there will be an accompanying increase in the thermal bow in the panel 10. When combined with a sandwich panel connector grid 22 that provides partial composite action, these nearly rigid connections will have little effect on the magnitude of the wind-induced primary moment in the panel 10.

When the post-tensioning tendon 16 is a bar or rod, secondary nuts can be added within the panel 10 near the interior surface of each post-tensioning anchor plate 18. This eliminates one of the primary dangers of post-tensioning. The anchor plate 18 will be attached to each layer 12 and 20 of concrete, preferably using deformed bar anchors but alternatively using headed studs. The combination of the internal nut and the direct anchorage of the plate 18 to the concrete will provide a safety stop in the event of tendon failure, an event that is most likely during stressing.

The anchor plate 18 will be fabricated from either carbon or stainless steel. While stainless steel plate will provide significant reductions in heat transfer when compared with carbon steel, it is important to note that the anchor plates 18 exist only at the foundation and roof elevations on the panel. Therefore, the effects of the anchor plates 18 on the overall performance of the building are relatively limited.

To accommodate the tendons 16, the insulation 14 can be grooved at regular intervals across the panel length. Alternatively, the insulation 14 may be installed in strips at regular intervals, leaving longitudinal openings or channels between the strips open to the first layer of concrete 12. In either case, the tension element of the tendon 16 is contained within a duct or isolator 30 (FIG. 2). The preferred isolator 30 comprises a polymer sleeve, for example, a PVC pipe or extruded polymer sheathing. In any event, the isolator 30 serves to prevent bonding between the tension element 16 and the surrounding concrete, while allowing transfer of normal force between the concrete layers 12 and 20 and the tendon 16. Further, the isolator 30 can provide or be a component in the corrosion protection system for the tension element 16, where required.

The advantages of placing the post-tensioning tendons 16 within the plane of the insulation 16 include reduced number of prestressing tendons 16 and accompanying reduction in the labor required to install and stress the tendons 16, and increased protection for the tendons 16 against damage resulting from drilling into the concrete.

During post-tensioning, two anchorage points are required for each tendon. Each anchorage point comprises an anchor plate 18 and an anchor nut 28 or wedge grips. The "live" end is distinguished from the "dead" end in that the live end is the point at which the jacking force is applied to tension the tendon 16. The tendon 16 can undergo significant elongation at the live end. Significant energy is stored in the tendon 16 at this stage. If the tendon 16 or the anchorage system fails, the energy stored in the tendon 16 will be released rapidly and will result in launching of a portion of the tendon 16. Because workers are immediately adjacent to the tendon 16, the tensioning phase presents significant danger to those responsible for tensioning the tendons 16. Unfortunately, if the tendons 16 are not bonded to the concrete, this danger is still present after the panel is erected. During and after construction, drilling through and into panels is required for installation of other systems for the building. Tendons that are near the surface of a panel (such as those that would be installed at the centerline of a 3-inch layer of concrete) are particularly vulnerable to damage.

It is therefore clear that a system that reduces the quantity of tendons in a panel not only reduces material and labor costs, but reduces the potential danger of constructing the panel. It is further clear that providing increased effective concrete depth at each tendon will reduce the probability of damage and therefore reduce the danger associated with post-tensioning. Further, a system that provides a safety nut or lug that prevents the launching of a portion of the tendon will reduce the danger associated with post-tensioning The method may be used to construct panels 10 either in the plant or at the building site. The method provides increased economy for constructing site-cast sandwich panels with less material. It also provides the opportunity for the increased use of large, architectural quality precast panels.

The panel 10 may be constructed using an analysis procedure that is largely similar to that outlined in U.S. patent application Ser. No. 10/389,165, filed Mar. 14, 2003, which is incorporated herein by this reference. However, at least two deviations from that procedure exist.

First, the presence of the anchor plate 18 has an influence on the shear transfer between the concrete layers 12 and 20. It is therefore necessary to define two stiffness factors, $\omega_I$ and $\omega_{II}$, where $\omega_I$ describes the stiffness for the connectors over the field of the panel and $\omega_{II}$ describes the stiffness for the post-tensioning anchor plate. These factors are used to calculate normal forces in the concrete as well as shear forces in the connectors under normal and temperature effects.

Second, although a relatively minor factor, the effect of unbonded tendons must be considered. With bonded prestressing reinforcing (pre-tensioning), slip is relatively limited. In fact, for analysis purposes, the slip between the concrete and the strand is assumed to be zero. However, with unbonded post-tensioned construction, slip between the reinforcing and the concrete is relatively unconstrained. It should be noted, however, that the assumption of zero slip is important for analysis only if strain compatibility exists within the panel itself. Since, in typical sandwich panel construction, strain compatibility is not enforced, bonded prestressing has no advantages in terms of analysis. Instead, it is only necessary to make a conservative assumption of the stresses in the tendon at each load state in the panel.

In particular, the most indeterminate force is the tension force in the tendon at the strength limit state. However, if the strength at the mid-span of the panel is likely limited by the force developed in the panel shear connectors, the tension force in the strand is not a primary issue. It is important, however, that a lower bound tension force be assigned to the reinforcing to ensure that an understrength panel is not inadvertently designed.

In the preferred embodiment, the anchor plates 16 have been positioned in the casting bed when the concrete layers 12 and 20 are being formed and so are consolidated with and bonded to the concrete layers 12 and 20. In an alternative embodiment, pockets are formed in the concrete layers 12 and 20, and the anchor plates 16 are positioned in the pockets. The anchor plates 16 will still provide anchorage points for creating tension in the tendons 16 and compression in the concrete layers 12 and 20, but will not be as effective at transferring forces between the two layers of concrete 12 and 20.

In the previous descriptions, the word "tendon" has been used to describe a high-strength, longitudinal prestressing steel element. Within current U.S. practice, a tendon is more broadly defined to comprise, for unbonded post-tensioning applications, a complete assembly consisting of anchorages, prestressing element, and sheathing with coating. Further, anchorage devices are defined to comprise the hardware used for transferring a post-tensioning force from the prestressing steel to the concrete. It must be noted that many tendon (and therefore anchorage) devices are standard manufactured systems available from commercial sources. Although the previous descriptions and the associated figures primarily describe a threaded rod type of prestressing element with a special anchor plate, the broader available applications, including so-called monostrand systems (for example, the DYWIDAG® Monostrand Post-Tensioning System, DYWIDAG-Systems International GmbH), or fiber composite systems (for example, the SIKA® CarobDur® High Strength Post-Tensioning System, Sika AG) can also be used for the subject application.

Although the invention has been described with respect to a preferred embodiment thereof, it is to be also understood that it is not to be so limited since changes and modifications can be made therein which are within the full intended scope of this invention as defined by the appended claims.

We claim:

1. An insulated concrete panel, comprising:

(a) a first concrete layer;

(b) a second concrete layer spaced apart from the first concrete layer;

(c) an insulation layer;

(d) a plurality of connectors interconnecting the two concrete layers through the insulation layer and transmitting structural forces between the two concrete layers to provide composite characteristics to the wall panel, wherein the connectors are located wholly within the concrete layers; and (e) a post-tensioning tendon assembly extending generally within the panel length and positioned between the two concrete layers and embedded in the insulation.

2. A panel as defined in claim 1, wherein the post-tensioning tendon assembly comprises:

(a) a longitudinal element extending over the majority of the panel length;

(b) anchorage members interconnecting the concrete layers with the longitudinal element for transferring a post-tensioning force from the longitudinal element to the concrete layers.

3. A panel as defined in claim 2, wherein the longitudinal element is comprised of a high-strength rod, strand, or bar.

4. A panel as defined in claim 2, wherein the longitudinal element is placed in a space formed in the insulation layer.

5. A panel as defined in claim 2, wherein the longitudinal element is adjusted to produce tension in the longitudinal element and compression in the concrete layers.

6. A method for constructing an insulated concrete panel, comprising the steps of:

(a) placing a first layer of plastic concrete;

(b) placing a layer of insulation on the first concrete layer;

(c) inserting a plurality of connectors through the insulation layer into the first concrete layer such that the connectors are embedded into the first concrete layer while the concrete is plastic;

(d) positioning a post-tensioning tendon in the insulation layer;

(e) placing a second concrete layer on the insulation layer and consolidated around exposed end portions of the plurality of connectors;

(f) positioning in the concrete layers a pair of anchor plates a predetermined distance apart;

(g) allowing the concrete layers to gain strength through curing; and (h) adjusting the post-tensioning tendon to produce a force in the tendon and in the concrete layers.

7. A method as defined in claim 6, wherein the post-tensioning tendon comprises a high-strength longitudinal element and wherein the adjusting step comprises adjusting an end portion of the longitudinal element.

8. A method as defined in claim 7, wherein adjusting of the end portion of the longitudinal element produces tension in the longitudinal element and compression in the concrete layers.

9. A method as defined in claim 6, wherein positioning of the post-tensioning tendon occurs while the first concrete layer is still plastic or after the concrete has hardened.

10. The insulated concrete panel of claim 1, wherein the connectors have a low thermal conductivity.

* * * * *

UNITED STATES PATENT AND TRADEMARK OFFICE

CERTIFICATE OF CORRECTION

PATENT NO. : 7,237,366 B2
APPLICATION NO. : 10/601372
DATED : July 3, 2007
INVENTOR(S) : Donahey et al.

It is certified that error appears in the above-identified patent and that said Letters Patent is hereby corrected as shown below:

On the Title Page, Item (75) should read,

Inventors: Rex C. Donahey, West Des Moines, IA (US); Kim ~~Seeber~~ Seeber, Caontonment, FL (US); Robert T. ~~Lone~~ Long, Sr., Ames, IA (US)

Signed and Sealed this

Twenty-first Day of August, 2007

JON W. DUDAS
*Director of the United States Patent and Trademark Office*